United States Patent [19]

Holliday

[11] 4,410,172

[45] Oct. 18, 1983

[54] FEEDING MECHANISM FOR A COLLATOR

[75] Inventor: David H. Holliday, Seattle, Wash.

[73] Assignees: Carl Johnson; T. W. Secrest, both of Seattle, Wash. ; part interest to each

[21] Appl. No.: 855,273

[22] Filed: Nov. 28, 1977

[51] Int. Cl.[3] ..... B65H 39/11

[52] U.S. Cl. ..... 271/288; 271/297

[58] Field of Search ..... 271/173, 64, 297, 288, 271/289, 290, 291; 270/58; 209/657

[56] References Cited

U.S. PATENT DOCUMENTS

| | | | |
|---|---|---|---|
| 3,516,654 | 6/1970 | Mestre | 271/173 |
| 3,740,050 | 6/1973 | Jacobs | 270/58 |
| 3,774,906 | 11/1973 | Fagan et al. | 271/64 |
| 3,938,801 | 2/1976 | Holliday | 271/173 |
| 3,944,217 | 3/1976 | Greene et al. | 271/173 |

*Primary Examiner*—Bruce H. Stoner, Jr.

*Attorney, Agent, or Firm*—Thomas W. Secrest

[57] ABSTRACT

This invention is directed to a feeding mechanism for a collator. A collator comprises a number of bins wherein multiple copies and multiple pages are inserted into the bins. This feeding mechanism can insert papers into the bins and which papers can move downwardly and into the bins or can move upwardly and into the bins. In one version of this feeding mechanism it is possible for the feeding mechanism to feed the same page of the business papers, continuously, into the bins until all of that page has been inserted into the bins. In this version there is a saving of time and money and paper as it is not necessary to shut down the feeding mechanism while inserting the pages into the bins and thereby there is a saving of time and there is a saving of paper as paper is not wasted during the time the feeding mechanism is not operating.

2 Claims, 13 Drawing Figures

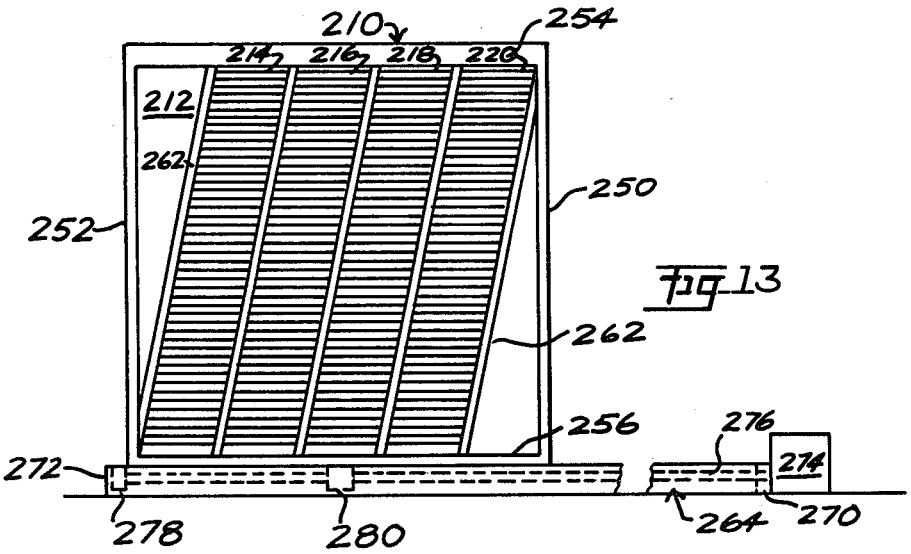
Fig 13
Fig 5
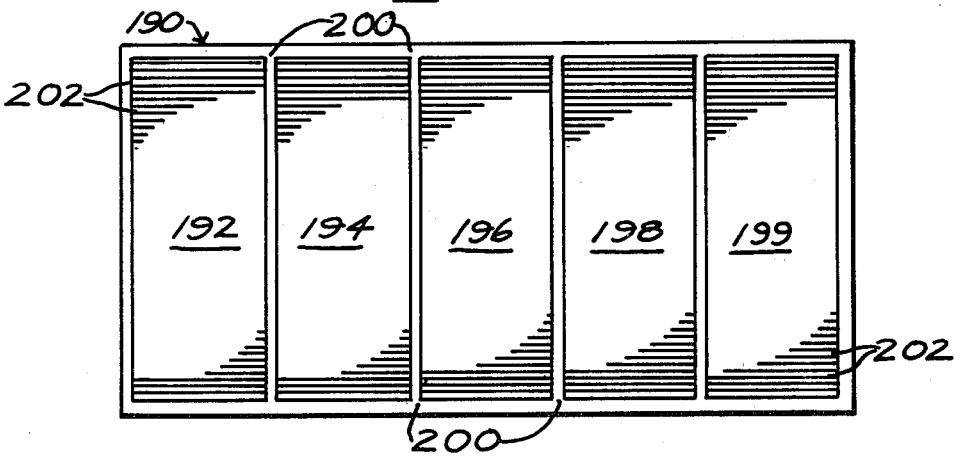
Fig 6
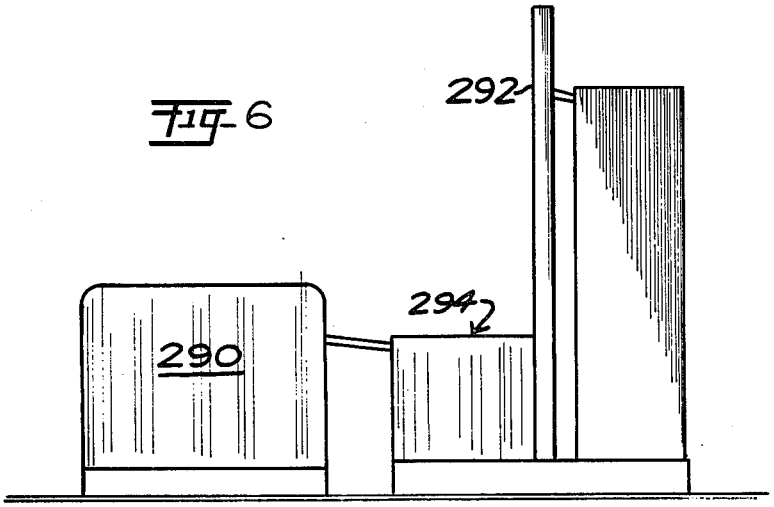

FEEDING MECHANISM FOR A COLLATOR

GENERAL BACKGROUND OF THE INVENTION

Reference is made to co-pending patent application Ser. No. 841,113, filed Oct. 11, 1977, now U.S. Pat. No. 4,159,825, entitled "REMOVABLE BIN SYSTEM IN A COLLATOR".

In many places there are reproduction centers or inplant reproduction centers. For example, in industry there are inplant reproduction centers. In commercial houses there are inplant reproduction centers. Also, in various government agencies there are inplant reproduction centers. These reproduction centers may produce cataloges, maintenance manuals for equipment, instruction books for operating equipment, brochures, sales material and specifications for bidders to use in making a bid. These are only a few of the uses to which a reproduction center may be used.

In a reproduction center there is used a printing machine such as an offset duplicator. The printed material from the offset duplicator must be collated so as to be made into the catalog, manual, instruction book and the like. It is possible to collate the printed material by hand. However, the cost of collating material manually is expensive and therefore self-defeating. As a result, at the present time, very few places use manual labor to collate the printed material.

In the last few years, in order to lessen the manual labor in the collation process and in order to lessen the cost and also to lessen the time required for collating, there has been developed apparatus to assist in the collating of the printed material. This apparatus has taken the form of a series of vertical bins. Each bin receives a copy of the printed material. There is a feeding apparatus for feeding the printed material to the bins. From experience, the number of vertical bins in a vertical column has been established as 52 bins. The feeding apparatus in feeding the printed material or printed sheet to a column of bins will feed the necessary sheets to one column of bins and then the column of bins in the feeding apparatus will move with respect to each other. In this time that the column of bins and the feeding apparatus move with respect to each other, the offset duplicator or printing apparatus is not operating. As a result, the image thickens and there becomes excess ink on the printing plate. The excess ink, upon being printed upon the next sheet of paper, appears messy and sloppy. In order to remove the excess ink from the printing plate, it is necessary to run a number of printed sheets such as say, ten printed sheets. This means that ten printed sheets have been wasted in order to clean the printing plate. This can be translated into a waste of time as well as a waste of paper. The press speed of many duplicators is nine thousand sheets per hour which means one hundred fifty sheets per minute or two and one-half sheets per second. With a collator having 52 bins in a vertical column, there is required approximately 3 to 4 seconds to move the bins and the feeding apparatus with respect to each other. Then, to start the offset duplicator printing, again, there is required another three-to-four seconds. Then to clean the printing plate, there is required about 10 copies of printed material or about 4 seconds. It is seen that this process of stopping the printing apparatus, moving the feeding apparatus and the vertical bins with respect to each other and then starting the printing apparatus again, requires from 10 to 12 seconds. To print the material to go into 52 bins requires approximately 20 seconds. In other words, the printing apparatus, the feeding apparatus, and the collating apparatus are wasting about one-half of the time required to print the printed page.

If the collating apparatus can function continuously, then there is a saving of approximately one-third of the time as it is not necessary to stop the printing apparatus. The printed pages can be printed continuously and collated into the bins.

It is my understanding that, at the present time, when a catalog or a maintenance manual or an instruction book or other multiple copies and pages are printed and collated the national average of copies is about 65 copies. As there are 52 bins in a vertical column of bins, this means that there must be two vertical columns of bins or one hundred and four bins. A large bank of bins will have 624 bins. Again, to repeat, from the above calculation if there is used a continuous operating collator there is saved about one-third of the time required in printing the printed sheet and in collating the printed sheet. A saving of one-third in time is a large percentage of saving or a large saving in time.

GENERAL DESCRIPTION OF THE INVENTION

The feeding mechanism carries papers for insertion into the bins of the bin frame.

The bins in a bin frame may comprise one column of 52 bins or may comprise more than one column of 52 bins such as 4 columns adjacent to each other. The bins in the column may be vertical or the columns may be at a slant or a bias so that the next upper bin maybe offset with respect to the next lower bin. As a result, the 52 bins in a column may give the column the appearance of being at an angle to the vertical or maybe at a bias or at a slant. Further, the bins in adjacent columns maybe so arranged that the uppermost bins in the first column may overlie the bottom bins in the next adjacent column. In this arrangement the feeding mechanism may feed, simultaneously, paper to the uppermost bins in the first column and also papers to the lowest bins in the next adjacent column. In this manner the feeding mechanism can feed papers to the bins in the columns in a continuous manner until all of the same page of the papers have been fed to the bins in the columns. For example, if there are to be 65 copies then all of the same page of the 65 copies can be fed continuously without stopping or shutting down the feeding mechanism or the printer. In addition, if there are 500 copies to be prepared then all of the same page of the 500 copies can be fed continuously to the bins without the necessity of shutting down the feeding mechanism and the printer and with the consequent saving of time and money.

This feeding mechanism is to constructed that it is possible for the papers to travel downwardly and into the bins or for the papers to travel upwardly and into the bins.

THE DRAWINGS

FIG. 5 is a front elevational view of bins in a bin frame and with the columns of bins being vertical;

FIG. 6 is a side elevational view of the collator, the feed table and the offline feeder or printer;

Figure 11:
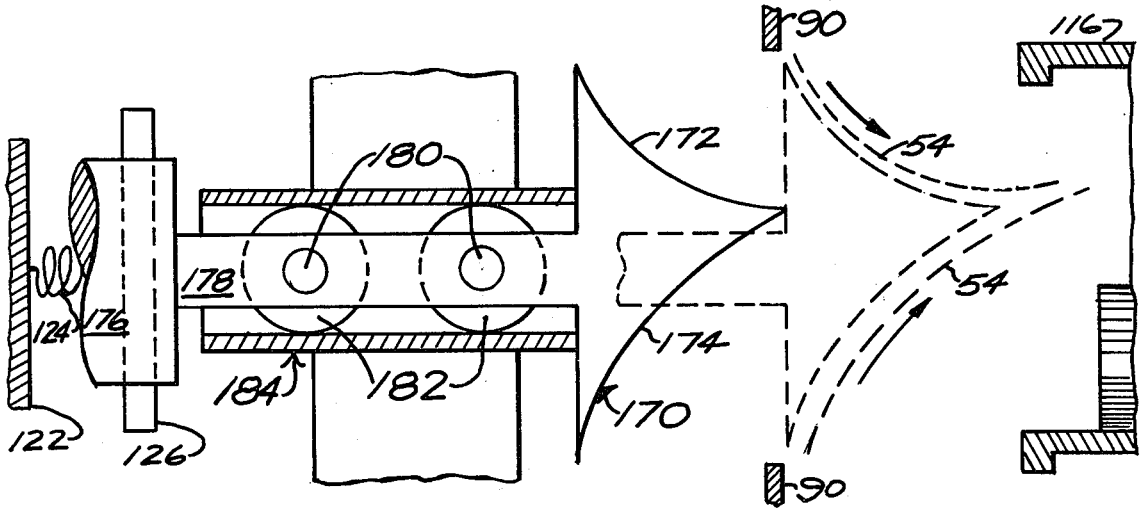
FIG. 11 is a schematic illustration of another species of an insertion gate and illustrates, in solid line, the retracted position of the insertion gate, in phantom line, the extended position of the insertion gate and shows a downwardly moving sheet of paper moving into a bin and also shows an upwardly moving sheet of paper for moving into the bins.
Figure 12:
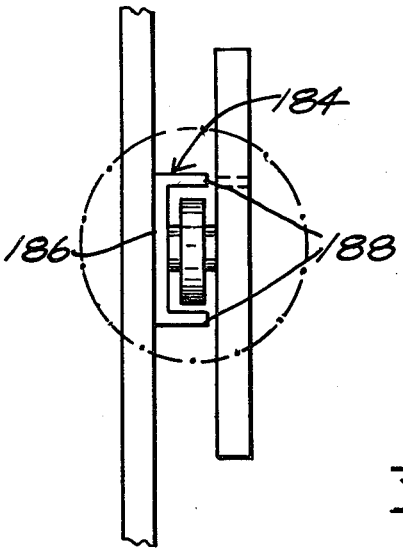

FIG. 12 is an isolated view of the insertion gate of FIG. 11 and illustrates the track and carriage mechanism for allowing the insertion gate to move between the retracted and extended positions; and, FIG. 13 is a front elevational view of the collator and illustrates the bins positioned one above another in a column but adjacent bins being, sightly, offset from each other, so as to illustrate the columns being at a bias or a slant and further, it is seen that the uppermost bins in the first column overlie the lowest bins in the next adjacent column.

SPECIFIC DESCRIPTION OF THE INVENTION

Figure 1:
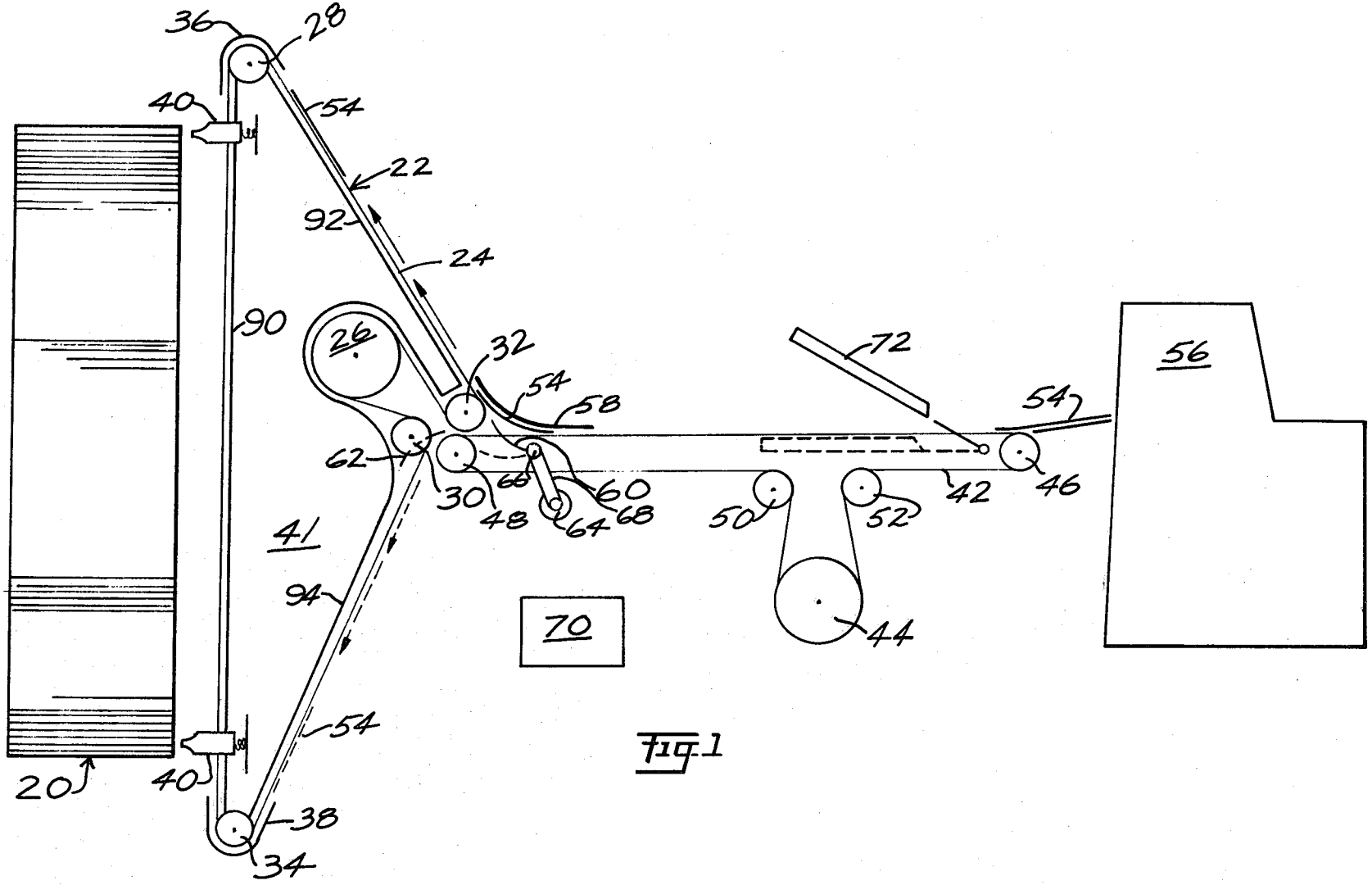
FIG. 1 is a side elevational schematic configuration of a bin tray, the feeding mechanism and an offline feeder or printer.

In FIG. 1 it is seen that there is a bin frame 20. The bin frame 20 will be more, particularly, described in a later part of this specification. There is a feeding mechanism 22 having a plurality of carrier belts 24. There is a drive motor and drive shaft combination 26. There is an upper shaft 28, a tensioning shaft 30, a middle shaft 32 and a lower shaft 34. The carrier belts 24 run around these shafts.

There is a curved over-the-top deflector shield 6 for assisting in directing the paper traveling upwardly on the feeder belt from the middle shaft 32 to the upper shaft 28 and then bending around the upper shaft 28 and traveling downwardly toward the lower shaft 34.

Also, there is curved under-the-bottom deflector shield 38 to assist in directing the paper flowing from the vicinity of the tensioning shaft 30 to the lower shaft 34 and curving around the lower shaft 34 and moving toward the upper shaft 28.

There are a number of insertion gates 40 for directing the paper to a desired bin.

There is a plenum chamber 41. The plenum chamber 41 has an air pressure less then the surrounding air pressure so that there is a vacuum with respect to the surrounding atmosphere. This vacuum, in conjunction with the surrounding atmosphere, assists in holding the paper onto the carrier belt 24. The insertion gates will be more, particularly, described with respect to this different species of these gates.

The feeding mechanism 22 also comprises a carrier web 42. The carried web runs around a drive motor and shaft combination 44, a rear shaft 46, a forward shaft 48, and two idler tensioning shafts 50 and 52.

The carrier web 42 carries paper 54 from the offline feeder or printer, duplicator, copier, or mimeograph machine 56 to the carrier belt 24.

In FIG. 1 it is seen that there is an upper deflector shield 58 for deflecting paper 54 from the carrier web 42 to the carrier belt 24. In addition to this upper deflector shield 58 there is a rotatable deflector gate 60, illustrated in solid line, for deflecting the paper from the carrier web 42 to the carrier belt 24 and with the carrier belt 24 traveling from the middle shaft 32 to the upper shaft 28.

In certain instances it is desirable that the paper 54 be transfered from the carrier web 42 to the carrier belts 24 which carrier belts are moving in the direction from the tensioning shaft 30 to the lower shaft 34.

The reader is to understand that it is possible for the drive motor and drive shaft to change directions so as to have the carrier belt run in a direction from the middle shaft 32 to the upper shaft 28 or for the carrier belt to run in a direction from the tensioning shaft 30 to the lower shaft 34.

To assist in transfering the sheet 54 from the carrier web 42 to the carrier belt 24 and running in the direction from the tensioning shaft 30 to the lower shaft 34 there is a lower deflector shield 62. Also, the rotatable deflector gate 60 may be rotated to be below the carrier web 42 and in the position as illustrated by the phantom line. Then, the sheet 54 will be traveling downwardly from the shaft 30 toward the shaft 34 and then upon bending around the lower shaft 34 will be traveling upwardly.

To rotate the deflector gate 60 there is a motor and a shaft 64. The deflector gate 60 is positioned on a rotatable shaft 66. A drive belt 68 runs between the motor and shaft 64 and the rotatable shaft 66.

There is a control sensor means 70 for controlling the drive motor and shaft combination 26 and also the insertions gates 40.

In FIG. 1 it is seen that there is a rotatable overshoot tray 72 positioned to interupt the flow of paper 54 from the feeder 56 or printer 56. In FIG. 1 it is seen, in solid line, that the overshoot tray 72 is in a position to interupt the flow of paper 54. Also, in phantom line it is seen that the overshoot tray 72 is below the carrier web 42, when said carrier web 42 is traveling from the rear shaft 46 towards the foward shaft 48, and therefore does not interfere with the flow of paper 54. In certain instances, it maybe necessary to interfere with the flow of paper from the apparatus 56 to the feeding mechanism 22. For example, the initial printed paper from the printer 56 may be somewhat messy so the first three or four sheets maybe transfered to the overshoot tray 72 and when clearer printed sheets are made these can be transfered to the carrier belt 24.

Figure 2:
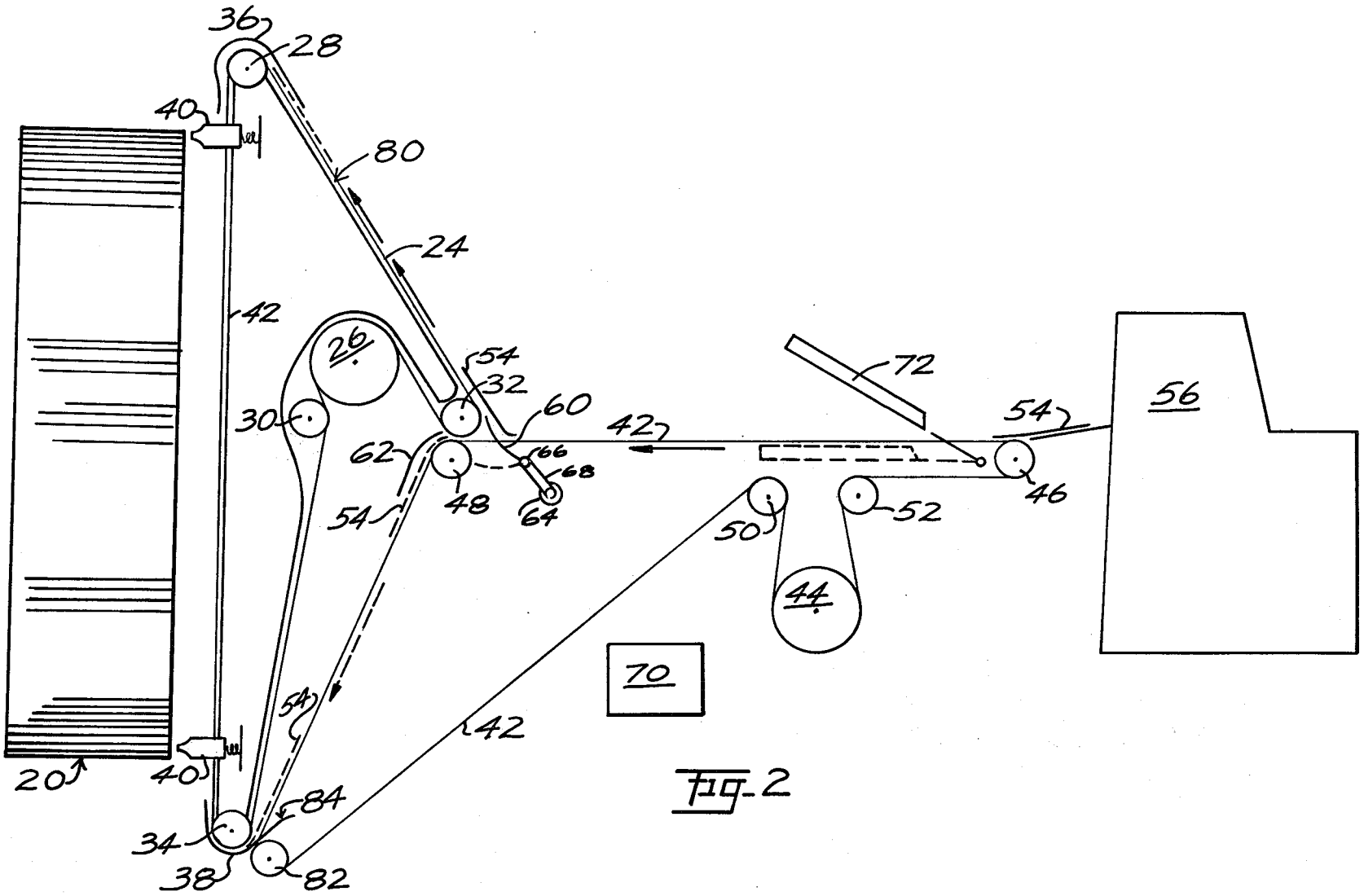
FIG. 2 is a side elevational schematic view of a bin tray, an offline feeder or printer and another version of the feeding mechanism.

In FIG. 2 there is illustrated another species 80 of the feeding mechanism. Again, there are carrier belts 24 and a drive motor and shaft combination 26, an upper shaft 28, a tensioning shaft 30, and a lower shaft 34. There is a plenum chamber 41 for holding the paper 54 onto the carrier belts 24.

There is an over-the-top deflector shield 36 and an under-the-bottom deflector shield 38.

The carrier web 42 runs around a drive motor and shaft combination 44, a rear shaft 46, a foward shaft 48, a lower shaft 82, and two idler and tensioning shafts 50 and 52.

There is a rotatable deflector gate 60, illustrated in solid line in FIG. 2, and which deflector gate deflects paper 54 from the carrier web 42 and onto the carrier belts 24 for movement from the middle shaft 32 to the upper shaft 28.

With the rotatable gate 60 lowered to be below the carrier web 42, running from the rear shaft 46 to the foward shaft 48, a lower deflector shield 62 deflects the paper 54 from the carrier web 42 so that the paper runs downwardly from the foward shaft 48 to the lower shaft 82 on the carrier web 42.

It is seen that the under-the-bottom deflector shield 38 has a finger or fingers 84 which extend into the carrier web and above the lower shaft 82 so that paper 54 traveling on carrier web 42 from the shaft 48 to the shaft 82 is deflected away from the carrier web 42 and onto the carrier belt 24. Again, there is a sensor and control means 70, an overshoot tray 72 and offline feeder or printer, duplicator, copier or mimeograph machine 56.

Figure 3:
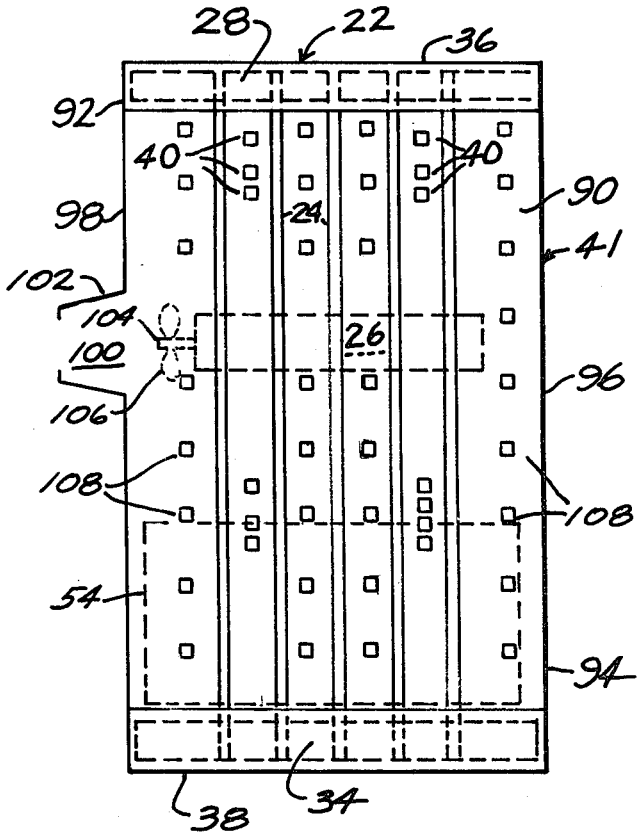
FIG. 3 is a fragmentary, front elevational view looking at the feeding mechanism and illustrating the vacuum plenum chamber for creating a vacuum to hold the papers onto the moving belts.

In FIG. 3 there is illustrated the feeding mechanism 22 in a front elevational view.

The feeding mechanism 22 comprises the plenum chamber 41 having a front wall 90, a rear wall 92 which curves around to accomodate the drive motor and drive shaft combination 26 and a lower rear wall 94. Also, there is a side wall 96 and a side wall 98. The side wall 98 has an opening 100 and which opening has a housing 102 extending outwardly from the side wall 98 and which housing 102 surrounds the opening 100.

The drive motor and drive shaft combination has a shaft 104 and on which shaft 104 there is mounted a fan 106. The fan 106 exhausts air from inside the plenum chamber 41, through the opening 100 and the walls 102 around the opening 100. This tends to create a vacuum inside the plenum chamber 41 so that there is a differential air pressure between the atmosphere outside of the plenum chamber 41 and the atmosphere inside of the plenum chamber 41. It is seen that there are a number of air holes 108 in the front wall 90 of the plenum chamber 41. This makes it possible for the air to flow from the outside of the plenum chamber to the inside of the plenum chamber and with the differential air pressure the sheets of paper 54 are held onto the carrier belts 24.

In FIG. 3 it is seen that there are a plurality of carrier belts and that a sheet of paper 54, in phantom line, is being carried by a carrier belt. Also, it is seen that there are two vertical rows of insertion gates 40. If a column of bins has 52 bins then there will be a set of 52 insertion gates, one insertion gate for each bin.

Figure 7:
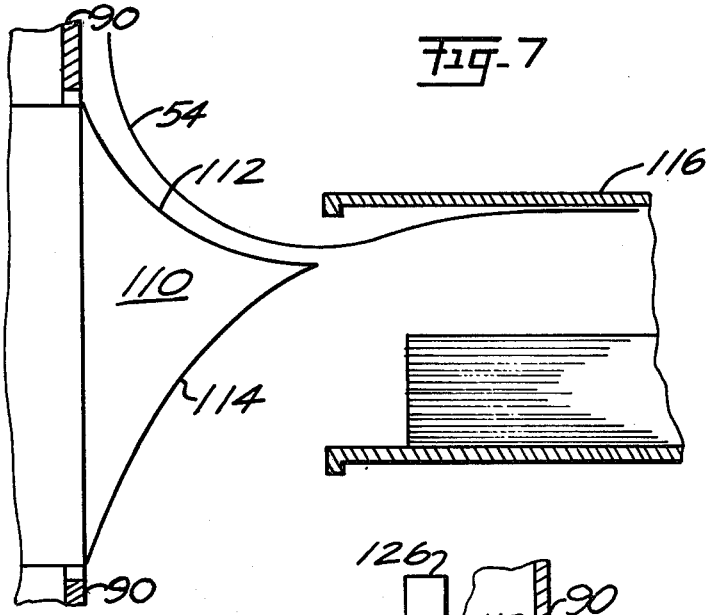
FIG. 7 is a fragmentary view of an insertion gate and with the paper traveling downwardly and into the bin.
Figure 8:
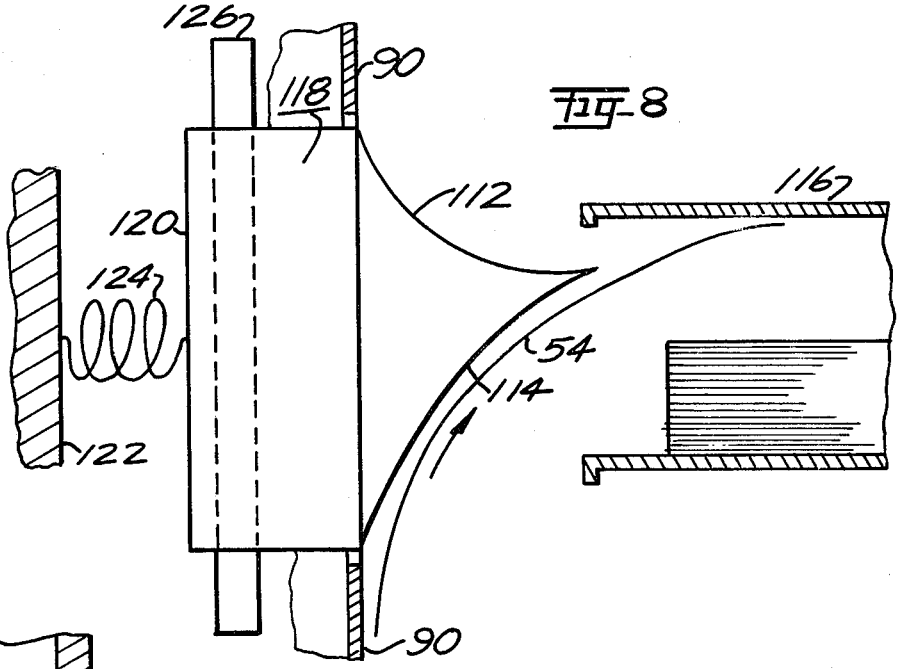
FIG. 8 is a fragmentary view of the insertion gate and illustrates the solenoid coil and spring for moving the insertion gate and, also, illustrates the upwardly moving paper and said paper being inserted into the bins.

In FIGS. 7 and 8 there is illustrated one species of insertion gate 110. It is seen that this insertion gate, in a side view, has an upper curved surface 112 and a lower curved surface 114. The width of the insertion gate may be one inch. The insertion gate is movable with respect to the bins 116.

It is seen that the insertion gate has a body 118 which extends backwardly, from the two surfaces 112 and 114, and that the body has a back 120. There is a support 122 in the plenum chamber 41. A retracting spring 124 connects with the support 122 and with the back 120 of the insertion gate. Also, there is a solenoid coil 126. In normal position the retracting spring 124 has moved the insertion gate away from the bin 116 and near the support structure 122. This allows the paper, either moving downwardly or upwardly, to pass by the insertion gate. Upon the activation of the solenoid coil 126 the insertion gate is moved fowardly towards the bin 116 so as to direct a downwardly moving piece of paper 54, see FIG. 7, into the bin 116 or to direct an upwardly moving piece of paper 54, see FIG. 8, into the bin 116. After the insertion gate has served its purpose and the deactivation of the solenoid coil 126 the spring 124 retracts the insertion gate so as to allow paper to pass by the insertion gate without being directed into the bin 116.

Figure 9:
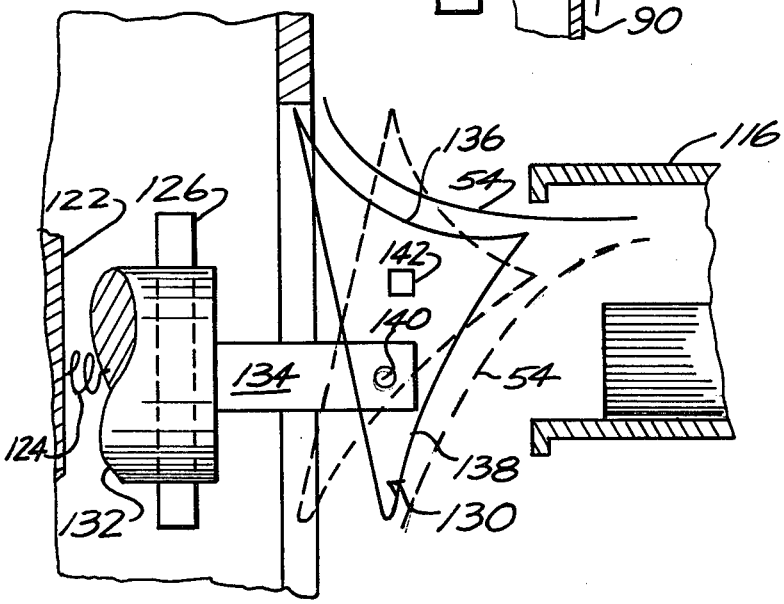
FIG. 9 is another species of an insertion gate and illustrates the coil and spring for moving the insertion gate and also illustrates, in solid line, the downwardly moving paper and said paper being inserted into the bins and illustrates, in phantom line, the upwardly moving paper and the insertion of this upwardly moving paper into the bins.

In FIG. 9 there is illustrated another species of an insertion gate 130. It is seen that this insertion gate has a body 132 and an arm 134. There is positioned on the arm 134 the insertion gate 130 having an upper curved surface 136 and a lower curved surface 138.

The insertion gate 130 is pivoted on a pin 140 on the arm 134. There is the support 122 and a retracting spring 124 connecting the support 122 with the body 132. Also, there is the solenoid coil 126 for moving fowardly the body 132 and the insertion gates. In FIG. 9 it is seen that there is a fixed member 142. The insertion gate 130 is free to rotate with respect to this fixed member 142 and to rotate around the pin 140. In FIG. 9, in solid line, it is seen that the insertion gate is rotated so as to have the sheet of paper 54, moving in a downwardly direction, directed into the bin 116. In phantom line in FIG. 9 it is seen that the insertion gate is so rotated that an upwardly moving piece of paper 54 is being directed into the bin 116.

Figure 10:
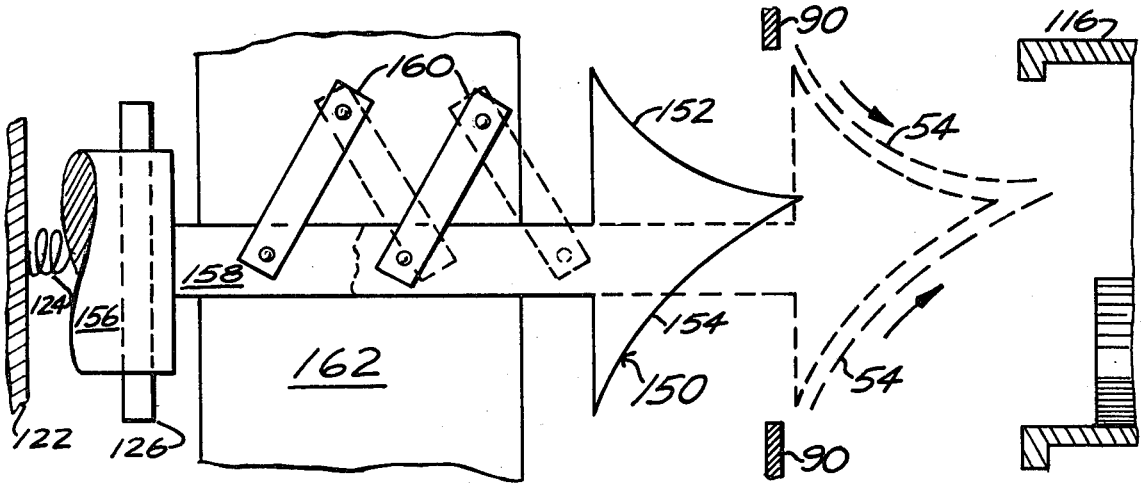
FIG. 10 is a schematic illustration of another species of the insertion gate and illustrates, in solid line, the insertion gate in retracted position and illustrates, in phantom line, the insertion gate in an extended position and with a downwardly moving sheet of paper for moving into the bins and, also, with an upwardly moving sheet of paper for moving into the bins.

In FIG. 10 there is illustrated another species of an insertion gate 150. The insertion gate 150 has an upper curved surface 152 and a lower curved surface 154. The insertion gate 150 has a body 156. The body 156 connects with the spring 124 which connects with the supporting structure 122. The body 156 has an arm 158 which connects with the insertion gate 150 having the surfaces of 152 and 154. There are two rotatable arms 160. The rotatable arms 160 are connected to a supporting structure 162 and also connected to the arm 158. There is a solenoid coil 126. With the solenoid coil deactivated the retracting spring 124 retracts the body 156 and the insertion gate 154 towards the support 122 and the arms 160 and the insertion gate 150 are in the position illustrated by the solid line. With the activation of the solenoid coil 126 the insertion gate moves forwardly, see the phantom line, and the arms 160 have been rotated as indicated in FIG. 10. With a downwardly moving sheet of paper 54 the surface 152 directs the paper 54 into the bin 116 and with an upwardly moving sheet of paper 54 the curved surface 154 directs the paper 54 into the bin 116.

In FIGS. 11 and 12 there is illustrated another species of an insertion gate 170 having a head with an upper curved surface 172 and a lower curved surface 174. It is seen that the insertion gate has a body 176. There is a retracting spring 124 connecting the body 176 to a support structure 122. Also, there is a solenoid coil 126.

The insertion gate has an arm 178 connecting the body 176 with the head. The arm 178 has two shafts 180. Mounted on each of these shafts is a wheel 182. There is a "U" shaped track 184 having a base 186 and two spaced apart arms 188. The wheels 182 run on these arms 188. In solid line in FIG. 11 it is seen that the solenoid is not activated and the retracting spring 124 has pulled the insertion gate 170 towards the support 122 so as to be out of the way of moving paper. In phantom line, it is seen that the solenoid coil is activated and that the insertion gate has been moved towards the bin 116 and that with a downwardly moving piece of paper 54 the upper surface 172 directs the paper into the bin 116 and with an upwardly moving piece of paper 54 the surface 174 directs the piece of paper into the bin 116.

In FIG. 3 it is seen that there are two columns of insertion gates 40 which act so as to direct the paper 54 into the appropriate bin.

In FIG. 5 it is seen that there is a bin frame 190 having five columns 192, 194, 196, 199 and 198 of bins. There are dividers 200 between the bins 202. In FIG. 5 it is seen that these columns are vertical. In operating the feeding mechanism 22 it is necessary to feed paper 54 into one of the vertical columns, then, either move the feeding mechanism 22 or move the bin frame 190 so that the feeding mechanism 22 can feed paper 54 into the other column. From experience, I have found that when the printer is stopped or shut down so as to able to move either the feeding mechanism or bin frame 190 the first few sheets printed are messy and cannot be used and have to be run into the overshoot tray 72. This means that there is a waste of paper and time because of the poor quality of the printed pages 54. Also, there is a waste of time because it is necessary to stop the printer while moving the feeding mechanism 22 or bin frame 190. This is one of the draw backs of vertical columns 192, 194, 196, 199 and 198 in the bin frame 190.

Figure 4:
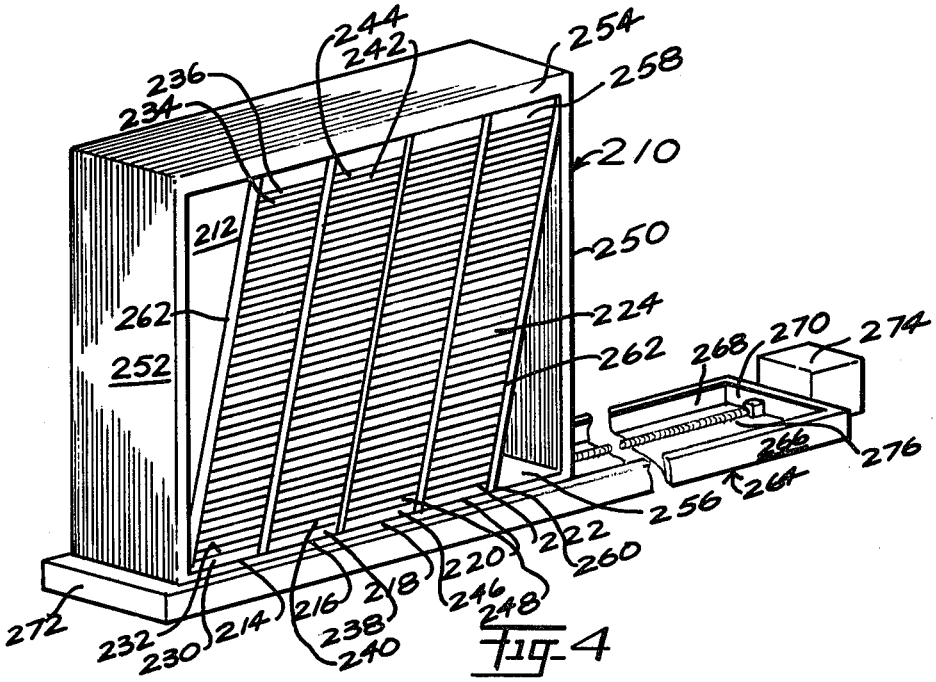
FIG. 4 is a perspective view looking at a specific embodiment of the collator and illustrating the column of offset bins and the means for moving these columns.

In FIGS. 4 and 13 it is seen that there is a collator frame 210 haing a bin frame 212. In the bin frame there are four columns 214, 216, 218 and 220. It is seen that there are a number of dividers 222 dividing the columns into bins 224. Also, it is seen that the bins are not vertical with respect to each other but overlie each other and extend over each other a slight distance, such as one quarter of an inch or one eighth of an inch. In a column of 52 bins the columns appear to be at a slant or at a bias.

In column 214 the reference numeral 230 is assigned to the lowest bin and the reference numeral 232 to the next lowest bin. Also, in column 214 the reference numeral 234 is assigned to the next to the top bin and the reference numeral 236 is assigned to the top bin. Then, in column 216 the reference numeral 238 is assigned to the lowest bin and the reference numeral 240 is assigned to the next lowest bin. In FIG. 4 it is seen that the bin 234 in the column 214 substantially, overlies the bin 238 in the column 216 in the bin 236 in the column 214, substantially, overlies the bin 240 in the column 216. Likewise, for the next to the top bin 242 in column 216 in the top bin 244 in column 216 and the lowest bin 246 in column 218 and the next to the lowest bin 248 in column 218 are so arranged that the bin 242 substantially overlies the bin 246 and the bin 244 substantially overlies the bin 248. This arrangement is the same for the top bins in column 218 and the bottom bins in column 220. With the columns at a slant and the uppermost bins overlying the lower most bins it is possible to run the feeding mechanism continuously as the collator frame 210 and the bin frame 212 can be moved past the feeder mechanism. Also, it is possible to, simultaneously, introduce a page into the bin 234 and a page into the bin 238 and to introduce, simultaneously, a page into the bin 236 and a page into the bin 240. For example, assume that there are 200 sheets of a certain printed page. It is possible to run the feeder mechanism 22 so as to feed into the bins in the bin frame 212, continuously, and without stopping. It is possible to introduce the first sheet and run the feeder continuously through the next 199 sheets so as to have 200 sheets fed into the bins in the bin frame 212. It is not necessary to shut down the printer and to shut down the feeding mechanism. All of the same printed page can be fed, in one run, and, continuously, into the bins in the bin frame 212. There is a savings of time as it is not necessary to shut down the printer and feed mechanism and there is a saving in materials as there are no wasted pages because the first few pages for a new column of bins are satisfactory and do not need to be discarded.

In FIG. 4 there is seen that there is a collator frame having two spaced apart sides 250 and 252, a top 254 and a bottom 256. In the collator frame 210 there is a bin frame having an upper support 258, a bottom support 260, and slanted columns support 262. Also, it is seen there is a support frame 264 having two spaced apart sides 266 and 268 and two spaced apart ends 270 and 272. The support frame 264 is integral. The support frame 264 supports the collator frame 210 and also acts as a guide for the rectilinear movement of the collator frame 210 and the bin frame 212.

At one end of the support frame 264 and outside of the end 270, there is a control and motor unit 274. The control and motor unit 274 connects with and drives the screw shaft 276. The screw shaft 276 connects with the collator frame 210 for moving the collator frame. The details of construction of the support frame 264, the screw shaft 276 and the collator frame 212 with respect to the connection with the screw shaft 276 in the manner of moving the collator frame 212 is more completely described in U.S. Pat. No. 3,938,801, issueing date of Feb. 17, 1976, entitled CONTINUOUS OPERATING COLLATOR. In FIG. 13 it is seen that there is a bearing 278 near the outer end 272 of the frame 264 and that there is a bearing 280 for the screw shaft 274. The bearing 280 connects with the collator frame 210 so that with the rotation of the screw shaft 276 the collator frame 210 moves in the frame 264 and, likewise, the bin frame 212 moves with respect to the frame 264. In this manner the bins in the bin frame 212 move past the feeding mechanism. It is not necessary to move the feeding mechanism. The bins move past the feeding mechanism and is possible for the feeding mechanism to move printed pages into the respective bins.

The sensor and control means 70 can control the feeding mechanism 22 and the activation and deactivation of the insert gates and also can control the movement of the collator frame 210 on the frame 264.

By way of summary, the reader can imagine many copies of a single page to be collated. In a manual there may be ten pages or twenty pages or one hundred pages, as an example. It is necessary to collate each of these pages. Also, there are many copies of each page. There may be twenty-five manuals to be prepared or two hundred manuals to be prepared or more manuals to be prepared. With my invention, it is possible to start printing the many copies of said one page and to, continuously, collate these copies without stopping the printer and without stopping the collating machine. For example, if there are five hundred copies of one page, it is possible to continuously run the five hundred copies on the printer and to feed these five hundred copies to the collator without stopping the printer and without stopping the collator. With prior equipment it has been necessary to run fifty-two copies, stop the printer and to move the collating apparatus or the feeding apparatus and then start the printer. With the start of the printer, three or four copies are thrown away as the ink has congealed on the printing apparatus, and in order to get good copies, the first three or four copies are thrown away. With my apparatus, it is not necessary to stop the printer and thereupon start the printer again, and to throw away three or four copies as once the printer is started. As a result all of the copies of that one page can be printed, such as five hundred copies of a page. There results a saving in time which is translated to a saving in money. Also, the saving in time means that there is a greater output of printed pages from a printing apparatus. In fact, in certain instances, it may be possible to increase the output of existing printing apparatus to such a degree that additional apparatus need not be purchased or need not be used. This, in itself, also results in a saving of money. The utility of this apparatus is apparent in the reading of this application and knowing that many copies of a page can be continuously collated without stopping the printing apparatus and the collator.

In FIG. 6 there is illustrated a printer 290 for use in conjunction with the offline feeder 292 and the feed table 294. In order to have printed pages for collating, it is necessary to have a printer 290. The printer may be an inexpensive mimeograph machine, or it may be a high speed copier used in an office, or it may be an inexpensive printer. The offline feeder 292 with a plurality of feed gates has been described previously in this patent application. Also, the bin frame section for holding the bins has been described.

From the foregoing and having presented my invention, what I claim is:

1. A feeding mechanism for inserting copies of pages in the bins of a collator, said feeding mechanism comprising:

a. a plurality of insertion gates for directing said copies into said bins;

b. a carrier for carrying said copies to said insertion gates;

c. a drive means for driving said carrier so that said carrier is capable of carrying said copies downwardly from a position adjacent to the top bin to a position adjacent to the bottom bin to said insertion gates and also for driving said carrier so that said carrier is capable of carrying said copies upwardly from a position adjacent to the bottom to a position adjacent to the top bin to said insertion gates;

d. said insertion gates having downwardly curved feed guides for directing said copies moving downwardly into said bins, and having upwardly curved feed guides for directing said copies moving upwardly into said bins;

e. a suspension means for said gates comprising a guide and a roller;

f. said suspension means, operatively, connecting with said insertion gates; and, g. a moving means, operatively, connecting with said insertion gates for moving said insertion gates for directing said copies into said bins.

2. A combination of a collator having bins and a feeding mechanism for inserting copies of pages in said bins, said feeding mechanism comprising:

a. a plurality of insertion gates for directing said copies into said bins;

b. a carrier for carrying said copies to said insertion gates;

c. a drive means for driving said carrier so that said carrier is capable of carrying said copies downwardly from a position adjacent to the top bin to a position adjacent to the bottom bin to said insertion gates and also for driving said carrier so that said carrier is capable of carrying said copies upwardly from a position adjacent to the bottom to a position adjacent to the top bin to said insertion gate;

d. said insertion gates having downwardly curved feed guides for directing said copies moving downwardly into said bins, and having upwardly curved feed guides for directing said copies moving upwardly into said bins;

e. a suspension means for said gates comprising a guide and a roller;

f. said suspension means, operatively, connecting with said insertion gates; and, g. a moving means, operatively, connecting with said insertion gates for moving said insertion gates for directing said copies into said bins.

* * * * *